United States Patent [19]

King

[11] 4,248,388

[45] Feb. 3, 1981

[54] APPARATUS FOR CANCELLING NON-REFILLABLE GLASS BOTTLES

[76] Inventor: Michael T. King, 1105 Indianwood Dr., Brookfield, Wis. 53005

[21] Appl. No.: 78,650

[22] Filed: Sep. 24, 1979

[51] Int. Cl.³ ..... B02C 4/02

[52] U.S. Cl. ..... 241/99; 241/101.5; 241/227; 198/503

[58] Field of Search ..... 198/445, 503; 241/101.2, 99, 101.5, 227

[56] References Cited

U.S. PATENT DOCUMENTS

| | | | |
|---|---|---|---|
| 583,111 | 5/1897 | Fried | 198/503 X |
| 1,333,975 | 3/1920 | Harrington | 198/503 X |
| 1,754,047 | 4/1930 | Reaves | 198/445 X |
| 2,187,842 | 1/1940 | Rheinstrom | 198/503 X |
| 3,504,621 | 4/1970 | Qualheim | 241/99 X |

*Primary Examiner*—Mark Rosenbaum

*Attorney, Agent, or Firm*—Andrus, Sceales, Starke & Sawall

[57] ABSTRACT

Apparatus for cancelling non-refillable bottles has an unloading section, where the bottles are received and sorted for color, if necesssary. The bottles then proceed to a counting section having a plurality of counting channels containing counters for the passing bottles. After counting, the bottles pass to a crusher section which cancels the bottles by breaking. A second unloading station may be provided at the input of the crusher for bottles which do not need to be counted.

16 Claims, 4 Drawing Figures

APPARATUS FOR CANCELLING NON-REFILLABLE GLASS BOTTLES

In an effort to reduce litter, many states require consumers to pay a deposit on the non-refillable glass bottles now in use for beverages and other products. The deposit is refunded when the bottles are returned. In order that the bottler or distributor not pay more than one refund, it is necessary to "cancel" each bottle so as to render it unusable. This is most simply and commonly accomplished by breaking the bottle.

The present invention is, therefore, directed to improved apparatus for cancelling non-refillable bottles. The bottles so cancelled may be counted to insure proper accounting of refund monies. The apparatus prepares the glass of the bottles for recycling, as by conversion to cullet or other products useful in the glass making process.

Briefly, the apparatus includes an unloading and sorting section at which containers of bottles are unloaded from material handling equipment. The unloading section has a moving belt receiving the bottles as they are dumped from the cases or other containers. The bottles may be sorted by color in the unloading section. From the unloading section, the bottles pass to a counting section having a plurality of counting channels along which the bottles pass for being counted by a counting means. Each counting channel has its own moving belt which is preferably canted so as to direct the bottles along the side of the channel where the counting means is located, thereby to insure accurate counting. A crusher section receives the bottles after counting for cancelling them by crushing. The crushed glass is stored in a bin for further recycling.

A second unloading station may be provided at the input of the crusher section for bottles not requiring counting. Means may be provided at the unloading station for conveying the bottle cases to a baler for recycling.

The invention will be further understood by reference to the drawing containing the following figures.

Figure 1:
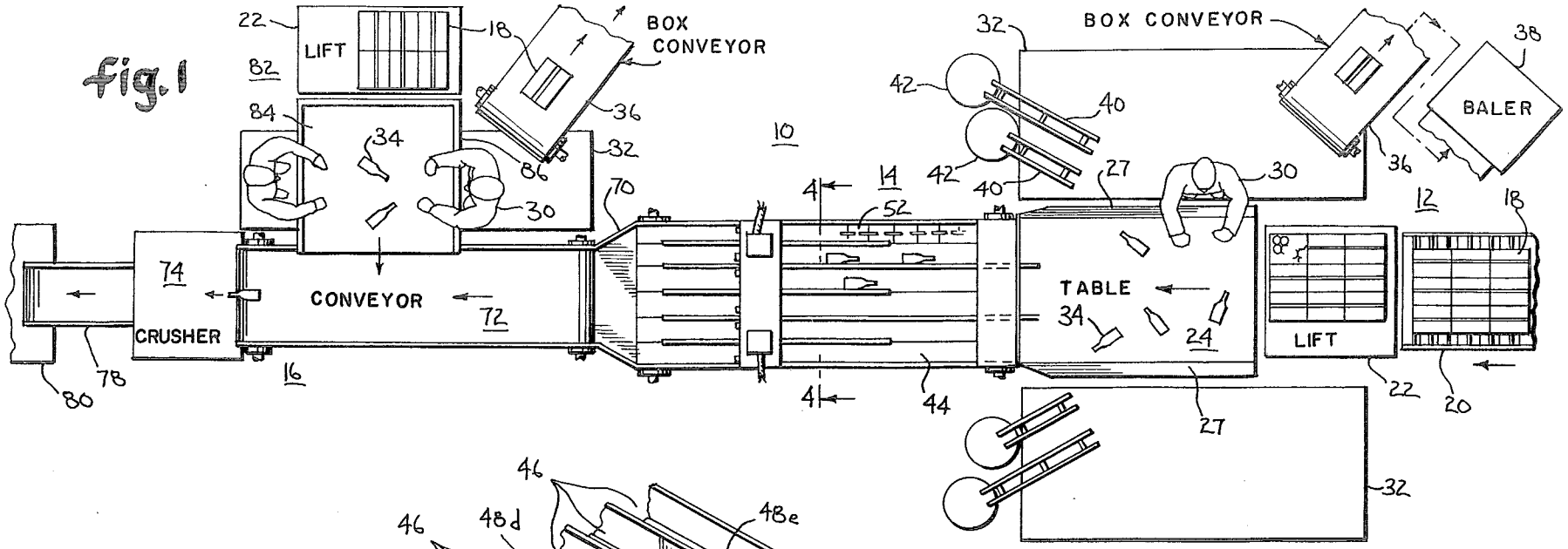
FIG. 1 is a plan view of the improved apparatus of the present invention.
Figure 2:
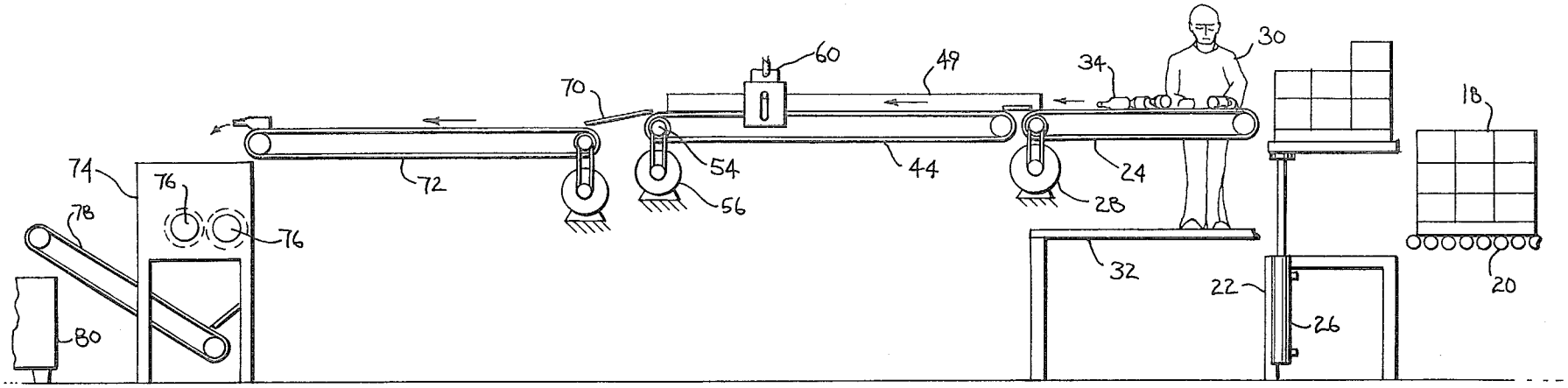
FIG. 2 is a side view of the apparatus of the present invention.

In FIGS. 1 and 2, the apparatus of the present invention is indicated by the numeral 10. The bottles to be cancelled proceed generally from right to left in FIGS. 1 and 2. Apparatus 10 includes an unloading and sorting section 12, a counting section 14, and a crushing section 16.

The bottles, such as beverage bottles, are usually brought to cancelling apparatus 10 in cases 18. As shown in FIGS. 1 and 2, stacks of cases 18 are supplied to the unloading and sorting section 12 at the right end of apparatus 10 on roller conveyor 20 as by palletized material handling equipment, not shown. After movement down conveyor 20, cases 18 are placed on lift 22. Lift 22 raises the stack of containers 18 to a level convenient for tipping them onto moving belt 24. Lift 22 may employ hydraulic cylinder mechanism 26 for raising and lowering the lift.

The upper portion of moving belt 24 moves from right to left, as shown in FIGS. 1 and 2. Belt 24 may be driven by hydraulic motor 28. Operators 30 standing on platforms 32 at either side of belt 24 take the containers 18 from the lift 22 and invert them to spill bottles 34 onto belt 24 between edge rails 27. The cases are then placed in box conveyor 36 for transport to baler 38 for baling and recycling as scrap paper.

It is preferable that containers 18 and bottles 34 be pre-sorted by color, i.e. flint (clear), amber, or green glass, so that bottles of only a single color are processed at any given time through the apparatus. The glass product provided by apparatus 10 from the cancelled bottles will then be of one color and hence readily usable for recycling. In the event bottles of a different color than that being primarily processed appear on belt 24, these bottles are picked out by operator 30 on the belt and placed in chutes 40 for delivery to bins 42. Two chutes and bins 40–42 are provided for each operator, one for each of the two colors not being primarily processed.

From the moving belt 24 of unloading and sorting station 12, bottles 34 pass to counting section 14 where the bottles may be counted so that the distributor or bottler receives proper credit for refunds paid on bottles 34 being cancelled. For this reason, counting section 14 must provide accurate counting of the bottles. Counting section 14, therefore, separates the randomly arranged bottles on belt 24 into parallel streams of aligned bottles and is so constructed as to insure counting of each of the bottles in the aligned streams.

Counting section 14 includes a moving belt means 44 for moving the bottles through counting section 14 in a plurality of counting channels 46 which form the parallel streams of bottles 34. Counting channels 46 are established by spaced, vertical divider plates 48 extending parallel to the direction of movement of belt means 44 and edge rails 49. While a plurality of different types of belts may be used, it has been found advantageous to utilize a plurality of individual, parallel, belts 50, one of which is provided in each of counting channels 46. Belts 50 may be formed of a plurality of plates 52 linked together. Belts 50 are driven from a common shaft 54 driven by hydraulic motor 56.

Figure 3:
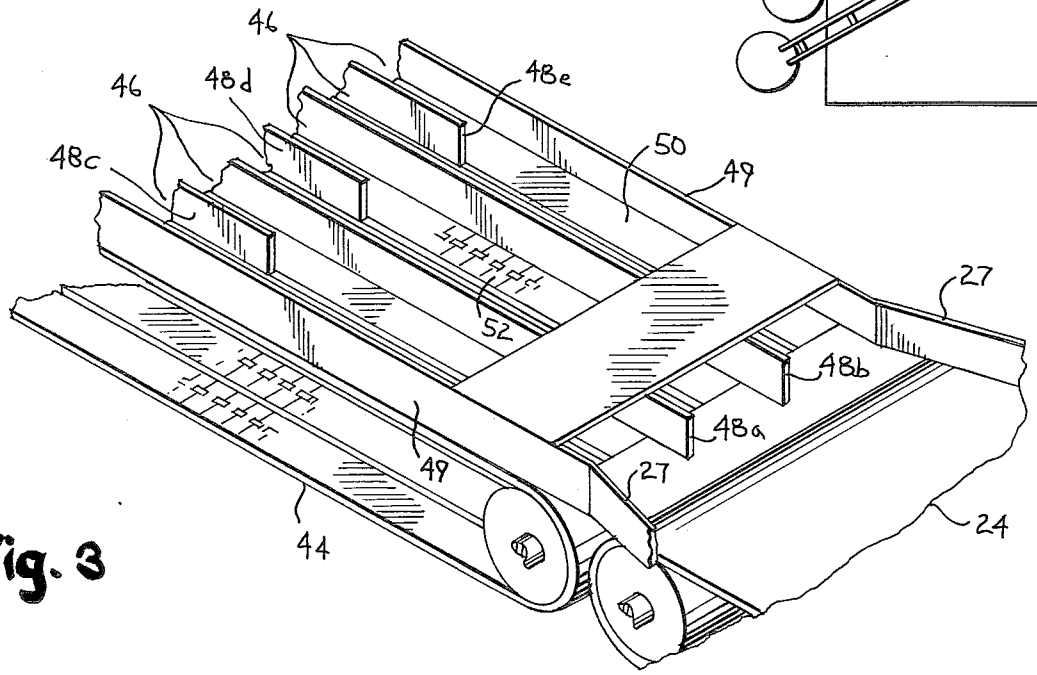
FIG. 3 is a perspective view of the input end of the counting section of the apparatus.

For accurate counting, it is desirable to orient bottles 34 end to end in channels 46. For this purpose, plates **48*a* and 48*b* extend to the beginning of the upstream end of counting section 14 as shown in FIG. 3 to commence the alignment of the randomly arranged bottles being received from belt 26. Plates 48*c*, 48*d*, and 48*e*, intermediate plates 48*a* and 48*d*, have their upstream ends cut away and assume full height in the medial portion of the counting section. Any bottle 34 not oriented by plates 48*a* and 48*b* will subsequently be forced into one of the counting channels 46 by striking the full height portions of plates 48*c*, 48*d*, and 48*e*. By the combined action of plates 48*a* through 48*e*, bottles 34 are arranged end to end in a plurality of streams in parallel channels 46**.

In order to insure accurate counting of the bottles, it is further desirable to provide spaces between the bottles 34 in the parallel streams in counting channels 46. For this purpose, belts 50 may be driven at a greater speed than belt 24 so that the bottles become separated as they move onto faster moving belts 50 from slower moving belt 24.

Figure 4:
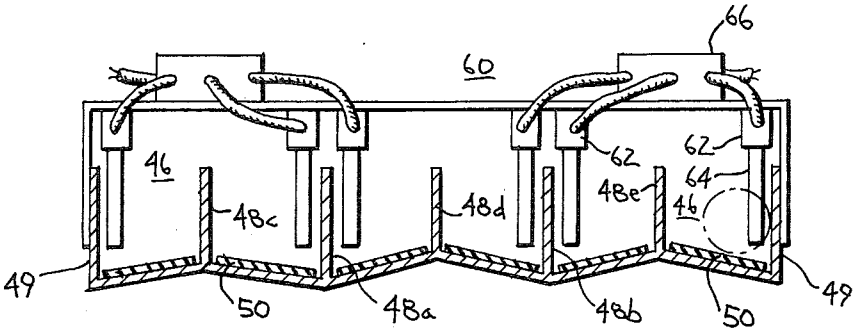
FIG. 4 is a detailed cross-sectional view taken along the line 4—4 of FIG. 1 showing the counting means of the apparatus.

Counting means 60 for bottles 34 is mounted over counting channels 46, as shown in FIGS. 1, 2, and 4. Counting means 60 includes counters 62 which may comprise limit switches having feelers 64 extending into counting channels 46 for being struck by the spaced bottles passing down the channels to execute a counting operation. The outputs of counters 62 may be provided to junction boxes 66 and ultimately to a totalizer, not shown, which sums the counts obtained from each of the counting channels.

To insure that all the bottles are counted, it has been found advantageous to cant belts 50 as shown in FIG. 4, so that the bottles in each counting channel are biased to roll against a specified one of plates 48 or edge rails 49. This establishes a defined position of the bottles in each channel. Preferably, belts 50 are so canted as to cause bottles in adjacent central counting channels to abut opposite sides of a common divider plate 48*a* or 48*b*. Feelers 64 for counters 62 are positioned in channels 46 so as to be struck by the bottles in the biased position.

If counting is not required, counting means 60 may be raised so that bottles 34 move freely down counting channels 46 without striking feelers 64.

After passage through counting section 14, the bottles spill off belts 50 down chute 70, onto conveyor 72. At the discharge end of conveyor 72, the bottles 34 are discharged into crusher 74 where they are cancelled by breaking. Crusher 74 is preferably a roll crusher and it has been found desirable to use a roll crusher in which each roll is separately driven by its own hydraulic motor 76. The output of crusher 74 passes up conveyor 78 to bin 80 for further processing, as into cullet.

A second unloading and counting station 82 is provided downstream of counting section 12 for bottles that do not need to be counted. Uncounted bottles and counted bottles from counting section 14 may thus be processed at the same time. Unloading station 82 includes moving belt 84 and edge rails 86 which feed bottles 34 onto conveyor 72. The operators 30 stand on platforms 32 and box conveyor 36 carries containers 18 to baler 38.

I claim:

1. Apparatus for cancelling non-reusable bottles comprising:

an unloading section having material handling means for receiving containers of bottles and positioning same for unloading and a moving belt onto which the bottles are unloaded from the containers;

a counting section for receiving bottles from said moving belt, said counting section having a plurality of adjacent moving belts extending along said section between pairs of spaced divider plates running parallel to the direction of movement of said adjacent belts, said divider plates and belts forming a plurality of counting channels for receiving and aligning the bottles and along which the bottles pass in seriatim on said adjacent moving belts, said belts being canted about their direction of movement to cause said bottles to assume defined positions in said counting section, said counting section having counting means for counting the bottles passing in said defined positions in said counting channels; and a crusher section for receiving the bottles from said channels and for cancelling same by crushing, said crusher section including storage means for the crushed glass of said bottles.

2. The apparatus according to claim 1 wherein said apparatus includes a conveyor interposed between said counting section and crusher section for receiving bottles from said counting section and supplying same to said crusher section.

3. The apparatus according to claim 1 including a second unloading section interposed between said counting section and crusher section, said second unloading section having material handling means for receiving containers of bottles not requiring counting and a moving belt onto which the bottles are unloaded from the containers for supply to said crusher section.

4. The apparatus according to claim 3 wherein said second unloading section includes a conveyor interposed between said counting section and crushing section.

5. The apparatus according to claim 1 wherein said moving belt of said unloading section is elevated and said material handling means includes a lift for elevating the containers of bottles.

6. The apparatus according to claim 1 wherein said unloading section includes means for receiving bottles sorted out of those on said moving belt.

7. The apparatus according to claim 1 wherein said unloading section includes baler means for conveying the empty containers from said section and for baling means.

8. The apparatus according to claim 1 wherein selected ones of said divider plates extend to the upstream end of said adjacent moving belts and wherein others of said divider plates have the upstream ends thereof cut away.

9. The apparatus according to claim 1 wherein said plurality of adjacent belts is driven by a common drive means.

10. The apparatus according to claim 1 wherein said counting means includes means extending into said channels and the path of the bottles for being struck thereby, to count the bottles.

11. The apparatus according to claim 1 wherein said counting means is movable between a counting position and a non-counting position.

12. The apparatus according to claim 1 wherein said belts are so canted as to cause bottles in adjacent central counting channels to abut opposite sides of a common divider plate.

13. The apparatus according to claim 1 wherein said crusher section includes a roll crusher.

14. The apparatus according to claim 13 wherein the rolls of said crusher each has a separate power means.

15. The apparatus according to claim 14 wherein said power means comprises hydraulic power means.

16. The apparatus according to claim 1 wherein said plurality of adjacent moving belts move faster than said moving belt of said unloading section to separate the bottles in the counting channels.

* * * * *